United States Patent [19]

Baty

[11] 4,381,167

[45] Apr. 26, 1983

[54] EXCAVATOR BUCKET LINKAGE

[75] Inventor: Mark A. Baty, Dubuque, Iowa

[73] Assignee: Deere & Company, Moline, Ill.

[21] Appl. No.: 258,100

[22] Filed: Apr. 27, 1981

[51] Int. Cl.[3] ..... E02F 3/58

[52] U.S. Cl. ..... 414/697; 414/723; 414/917

[58] Field of Search ..... 414/694, 723, 917, 697, 414/714, 715; 172/464, 479; 74/101, 105, 99, 518, 516

[56] References Cited

U.S. PATENT DOCUMENTS 3,251,491 5/1966 French et al. ..... 414/694
4,256,432 3/1981 Sugiyama ..... 414/694

FOREIGN PATENT DOCUMENTS 1568877 7/1969 France ..... 414/715

*Primary Examiner*—Robert J. Spar
*Assistant Examiner*—Donald W. Underwood

[57] ABSTRACT

First and second excavator bucket linkage embodiments each include first, second, third and fourth links. Each embodiment includes first and second links pivotally interconnected to each other and to the rod end of an extensible and retractable hydraulic actuator with the first link also being pivotally connected to the bucket. In the first embodiment, the third and fourth links are arranged in general parallelism with each other and have respective first ends pivotally connected to the second link and respective second ends pivotally connected to the dipper stick. In the second embodiment, the third link is pivotally connected between the dipper stick and the second link while the fourth link is pivotally interconnected between the third link and the bucket.

1 Claim, 4 Drawing Figures

EXCAVATOR BUCKET LINKAGE

BACKGROUND OF THE INVENTION

The present invention relates to excavator bucket linkages.

It is a common practice to pivotally mount an excavator bucket at the end of a dipper stick and to power-rotate the bucket between extreme roll-back and curled positions by means of an extensible and retractable hydraulic actuator operatively connected to the bucket by a linkage comprising a pair of links having respective first ends pivotally joined to each other and the actuator and respective second ends respectively pivotally connected to the dipper stick and the bucket.

The geometry of these conventional bucket linkages is such that the force developed at the bucket cutting edge, as the bucket is rotated from an extreme roll-back to an extreme curled position, begins at some initial value and increases rapidly to a maximum and then drops rather quickly.

SUMMARY OF THE INVENTION

According to the present invention, there is provided an improved excavator bucket linkage.

An object of the invention is to provide an excavator bucket linkage which produces a flatter bucket edge cutting force curve, as the bucket moves from an extreme roll-back to an extreme curled position, than is produced by a conventional linkage.

This object is accomplished by providing a bucket linkage having the capability of guiding the end of the extensible and retractable actuator along a path that is flatter than the path traced by the end of the actuator when coupled to a conventional linkage.

This and other objects will become apparent from a reading of the ensuing description, together with the appended drawings.

DESCRIPTION OF THE PREFERRED EMBODIMENT

Figure 1:
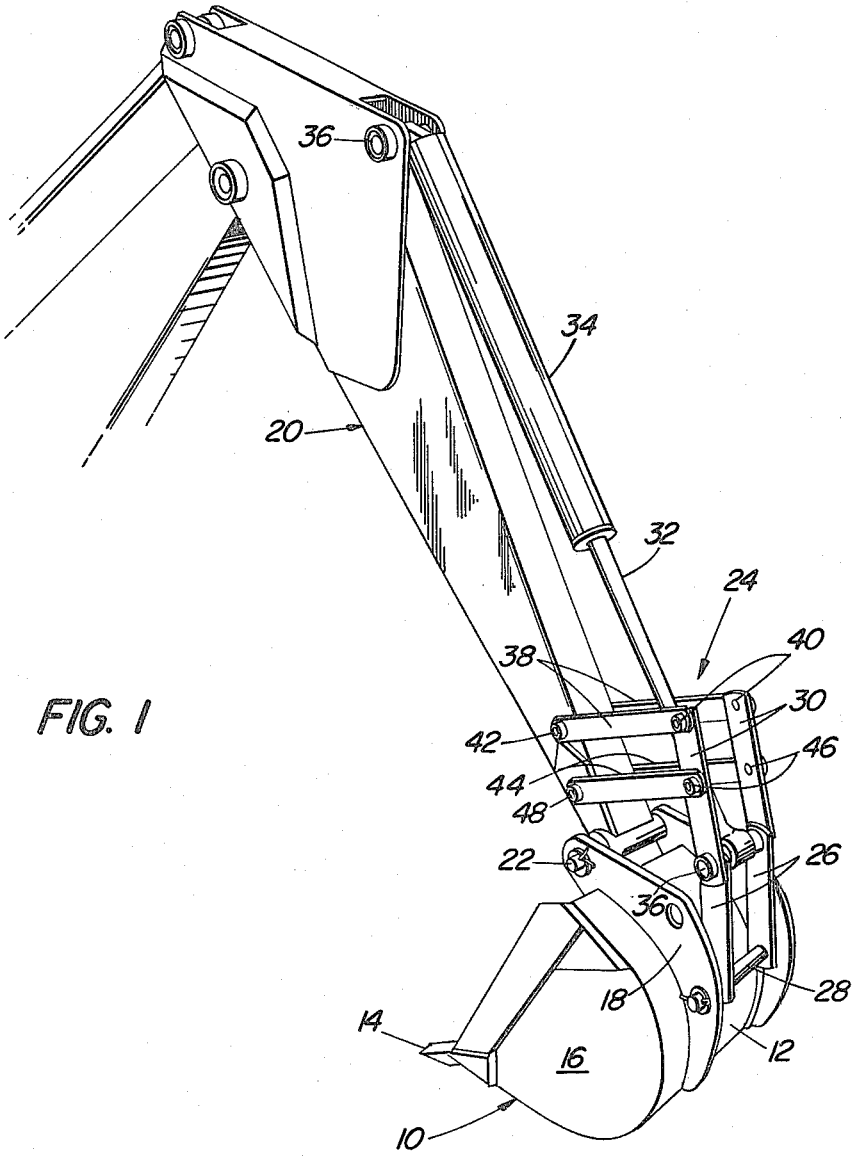
FIG. 1 is a right front perspective view of a dipper stick and bucket assembly embodying a bucket linkage constructed in accordance with a first embodiment of the invention.

Referring now to FIG. 1, therein is shown an excavator bucket 10 having a curved wall 12 defining a back and bottom of the bucket and terminating at a cutting edge here shown defined by a plurality of teeth 14 (only one visible). The bucket 10 has opposite sides defined by plates 16 that are joined to the opposite ends of the wall 12. Fixed to the backside of the wall 12 is a pair of transversely spaced, parallel, upright flanges 18.

A dipper stick 20 is positioned with its lower end between an upper portion of the flanges 18 and is pivotally connected thereto by means of a pin 22 which extends transversely through aligned holes provided in the flanges 18 and the dipper stick 20.

Provided for rotating the bucket 10 about the pin 22 is a powered linkage 24 connected between the dipper stick 20 and the bucket 10. Specifically, the linkage 24 includes a first pair of parallel bars located between the flanges 18 and defining a first link 26 having its lower end pivotally connected to a central portion of the flanges 18 by a pin 28. A second pair of parallel bars define a second link 30. The upper end of the link 26 is disposed between the lower end of the parallel bars of the link 30 and is pivotally connected thereto and to an eye at the end of a piston rod 32 of an extensible and retractable hydraulic actuator 34 by means of a pin 36. The cylinder end of the actuator 34 is pivotally connected to the dipper stick by a pin 36. The upper end of the parallel bars of the link 30 is located between first ends of a pair of parallel bars defining a link 38 and is pivotally connected to the link 38 by a pair of pins 40. The parallel bars of the link 38 are located on opposite sides of and are pivotally connected to the dipper stick 20 by a pivot pin 42. Disposed in parallel relationship to the bars defining the link 38 are a pair of bars which define a link 44. The pair of bars of the link 44 have respective first ends respectively pivotally connected to the pair of bars of the link 30 by a pair of pins 46 and have respective second ends pivotally connected to the dipper stick 20 by a pin 48.

Figure 2:
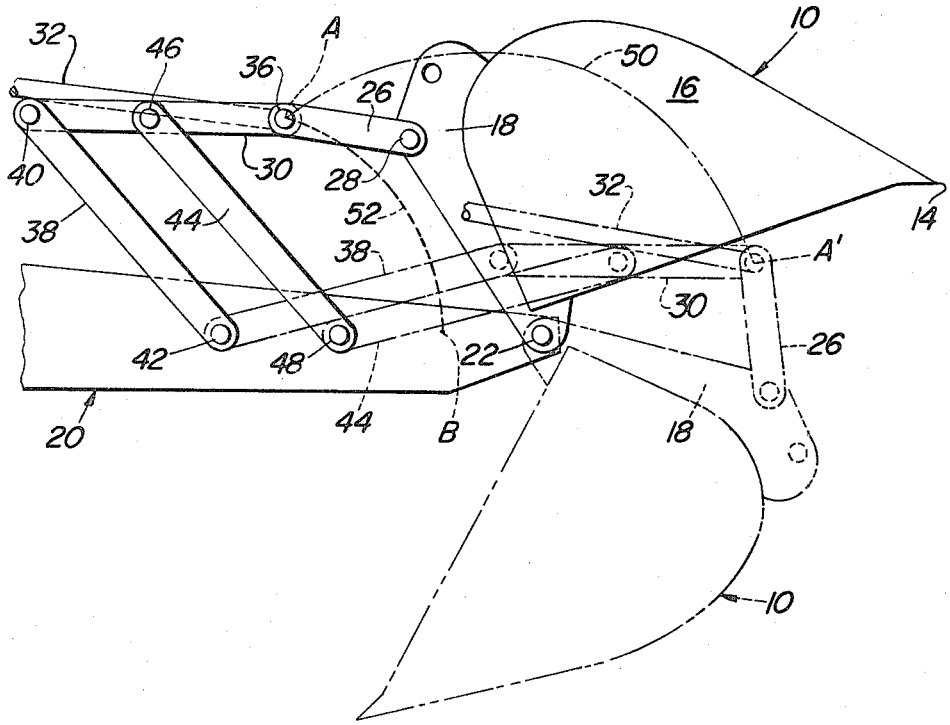
FIG. 2 is a side elevational view of the dipper stick and bucket assembly shown in FIG. 1 and showing, in broken lines, the path followed by the end of the actuator when moving the bucket between extreme positions and showing, in dashed lines, the path that the end of the actuator would follow during the same operation if the bucket linkage were conventional.

Referring now to FIG. 2, therein, the bucket 10 and linkage 24 are shown in their respective extreme roll-back positions. The pin 36 will move along a path 50 from point A to point A' as the linkage 24 is moved to its extreme curled position. On the other hand, a conventional linkage would be formed by replacing the links 38 and 44 by a link extending between pins 42 and 36, in which case the pin 36 would move along a path 52 from point A to point B as the conventional linkage moves from its extreme roll-back position to its extreme curled position. It can be observed that as the pin 36 moves along the path 50 from point A to A', the distance between the pin 36 and the pin 42 increases while the pin 36 remains at a constant distance from pin 42 as the pin 36, as embodied in the hypothetical conventional linkage, moves along path 52 between points A and B.

Figure 3:
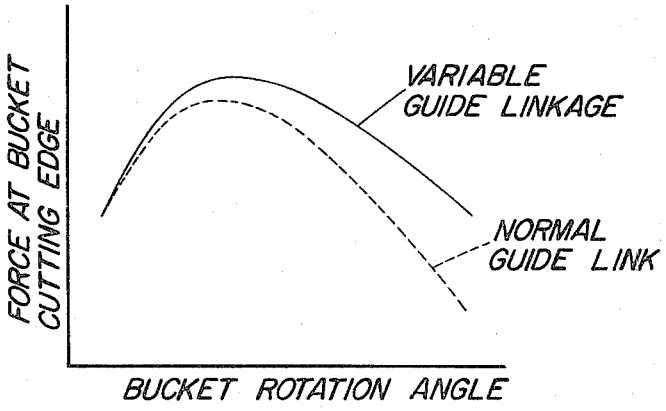
FIG. 3 is a graph showing a comparison between typical plots of the force at the cutting edge of the bucket vs. bucket rotation angle yielded by a linkage constructed in accordance with the present invention and a typical linkage.

Referring now to FIG. 3, therein is shown typical digging force curves that are produced by plotting the force developed at the cutting edge of the bucket 10 for each position of the bucket as it is rotated about the pin 22 from its extreme roll-back to its extreme curled position. The solid line trace is that produced when the bucket is rotated through means of the linkage 24 while the broken line trace is that which is produced when the bucket is rotated by means of a conventional bucket linkage constructed as described in the immediately preceding paragraph. Thus, it can be seen that the digging force curve produced by the bucket linkage 24 is flatter than that produced by the conventional bucket linkage and accordingly, that more digging force is available throughout most of the bucket travel.

Figure 4:
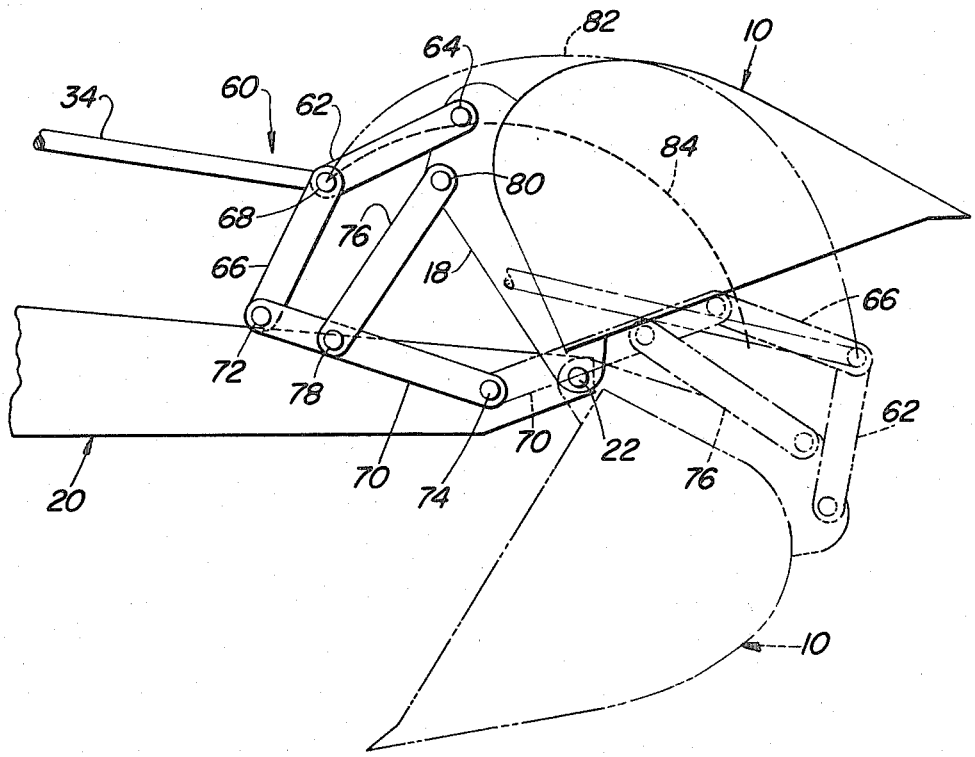
FIG. 4 is a view similar to FIG. 2 but showing another embodiment of a linkage constructed in accordance with the present invention.

Referring now to FIG. 4, therein is shown an alternative bucket linkage embodiment which also produces a flattened digging force curve in comparison to a conventional linkage. Specifically, a bucket linkage 60 is illustrated which includes a first link 62 having one end pivotally connected to the bucket flange 18 by a pin 64 and having a second end pivotally connected to a first end of a second link 66 and to the rod end of the actuator 34 by a pin 68. The second link 66 has a second end pivotally connected to a first end of a third link 70 by a pin 72 and the third link 70 has a second end pivotally connected to the dipper stick 20 by a pin 74. A fourth link 76 has a first end pivotally connected to the third link 70 by a pin 78 located between the opposite ends of the link 70 and somewhat closer to the pin 72 than the pin 74. A second end of the fourth link 76 is pivotally connected to the bucket flange 18 by a pin 80 located between the pivot pins 22 and 64 and somewhat closer to the pin 64 than to the pin 22. Trace 82 shows the path that the pin 68 follows during operation of the linkage 60 to move the bucket 10 from its extreme roll-back to its extreme curled position while the trace 84 is the path that the pin 68 would follow, during a similar operation of the bucket, if the links 66, 70 and 76 were replaced by a link extending between the pin 68 and the pin 74. Thus, it will be observed that like the linkage 24 described above, the linkage 60 causes the pin 68 to move so as to be increasingly displaced from the pin 74 as the bucket is moved from its extreme roll-back to its extreme curled position as opposed to the trace 84 which is arcuately curved at a fixed radius about the pin 74. It will be appreciated, then, that the force curve developed by the linkage 60 would be flatter than that developed by a conventional linkage of the described construction.

From the foregoing description, it is thought that the operation of the invention is clear so for the sake of brevity, a further description of the operation is foregone.

I claim:

1. In an excavator dipper stick and bucket assembly wherein the bucket is pivotally connected to one end of the dipper stick for movement about a first axis, a bucket linkage connected between the dipper stick and the bucket, and an extensible and retractable hydraulic actuator connected between the dipper stick and the linkage for effecting pivotal movement of the bucket upon extension or retraction of the actuator, the improvement residing in the linkage and comprising: a first link having an end pivotally connected to the bucket for movement about a second axis which is parallel to and spaced from the first axis; a second link having an end pivotally connected to a second end of the first link and to an end of the actuator, a third link having its opposite ends pivotally connected to a second end of the second link and to the dipper stick at a location spaced from the first axis; and a fourth link having opposite ends respectively pivotally connected to the third link and the bucket.

* * * * *